US005353459A

United States Patent [19]

Potter et al.

[11] Patent Number: 5,353,459

[45] Date of Patent: Oct. 11, 1994

[54] METHOD FOR INFLATING A BLADDER

[75] Inventors: Daniel R. Potter, Forest Grove; Joel L. Passke, Portland, both of Oreg.; David M. Forland, Battle Ground, Wash.

[73] Assignee: Nike, Inc., Beaverton, Oreg.

[21] Appl. No.: 114,223

[22] Filed: Sep. 1, 1993

[51] Int. Cl.[5] ..... A43B 13/20

[52] U.S. Cl. ..... 12/146 R; 36/29; 36/71; 156/147

[58] Field of Search ..... 36/71, 93, 29, 153, 36/43, 88; 5/449, 455, 456; 446/220, 221, 226; 206/522; 383/3; 441/40, 41, 90, 96, 99; 156/145, 147; 12/142 R, 146 R; 2/DIG. 3

[56] References Cited

U.S. PATENT DOCUMENTS

| | | | |
|---|---|---|---|
| 665,302 | 1/1901 | Aylmer | 441/41 |
| 900,867 | 10/1908 | Miller . | |
| 1,069,001 | 7/1913 | Guy . | |
| 1,625,582 | 4/1927 | Anderson . | |
| 1,869,257 | 7/1932 | Hitzler . | |
| 2,477,588 | 8/1949 | Dumm | 36/153 |
| 2,488,382 | 11/1949 | Davis | 36/153 |
| 2,645,865 | 7/1953 | Town . | |
| 2,677,906 | 5/1954 | Reed . | |
| 2,886,835 | 5/1959 | Monan | 441/96 |
| 3,030,640 | 4/1962 | Gosman . | |
| 3,575,757 | 4/1971 | Smith | 156/147 |
| 3,589,037 | 6/1971 | Gallagher . | |
| 3,758,964 | 9/1973 | Nishimura . | |
| 3,795,994 | 3/1974 | Ava | 36/29 |
| 3,925,838 | 12/1975 | Kennedy | 441/96 |
| 3,990,457 | 11/1976 | Voorhees | 36/153 |
| 4,017,351 | 4/1977 | Larson et al. . | |
| 4,049,854 | 9/1977 | Casey et al. . | |
| 4,107,931 | 4/1977 | Golden . | |
| 4,183,156 | 1/1980 | Rudy . | |
| 4,217,705 | 8/1980 | Donzis . | |
| 4,219,945 | 9/1980 | Rudy . | |
| 4,287,250 | 9/1981 | Rudy . | |
| 4,297,797 | 11/1981 | Meyers . | |
| 4,305,212 | 12/1981 | Coomer . | |
| 4,445,283 | 5/1984 | Meyers . | |
| 4,446,634 | 5/1984 | Johnson et al. . | |
| 4,670,995 | 6/1987 | Huang . | |
| 4,722,131 | 2/1988 | Huang . | |
| 4,768,295 | 9/1988 | Ito . | |
| 4,802,289 | 2/1989 | Gudager | 36/153 |
| 4,850,912 | 7/1989 | Koyanagi | 441/41 |
| 4,897,126 | 7/1989 | Yamashiro et al. | 206/522 |
| 4,912,861 | 4/1990 | Huang . | |
| 4,991,317 | 2/1991 | Lakic . | |
| 4,993,429 | 2/1991 | Krinsky | 36/153 |
| 5,023,118 | 6/1991 | Cheng | 446/221 |
| 5,025,575 | 6/1991 | Lakic . | |
| 5,083,361 | 1/1992 | Rudy | 156/145 |
| 5,108,339 | 4/1992 | Kieves | 446/221 |
| 5,137,154 | 8/1992 | Cohen | 383/3 |

FOREIGN PATENT DOCUMENTS

| | | | |
|---|---|---|---|
| 200963 | 12/1958 | Austria | 36/153 |
| 93001107 | 1/1993 | PCT Int'l Appl. | 206/522 |
| 81605 | 10/1986 | Taiwan . | |
| 123336 | 3/1990 | Taiwan . | |
| 134162 | 9/1990 | Taiwan . | |
| 160500 | 6/1991 | Taiwan . | |
| 173484 | 11/1991 | Taiwan . | |
| 184346 | 5/1992 | Taiwan . | |
| 2050145 | 1/1981 | United Kingdom . | |

*Primary Examiner*—Steven N. Meyers

*Attorney, Agent, or Firm*—Banner, Birch, McKie & Beckett

[57] ABSTRACT

The invention is directed to a method for inflating a bladder including a first and a second distinct chamber linked in fluid communication by an interconnecting port, and a fluid fill inlet linked in fluid communication with the first chamber. A first nozzle set at a first predetermined pressure level and connected to a first fluid pressure source is inserted in the fill inlet to thereby inflate the first and second chambers to the first predetermined pressure. The interconnecting port is sealed to isolate the first chamber from the second chamber out of fluid communication with each other such that the second chamber is isolated at the first predetermined pressure. The first nozzle is removed from the fluid fill inlet. A second nozzle set at a second predetermined pressure level and connected to a second pressure source is inserted into the fluid fill inlet to thereby inflate the first chamber to the second predetermined pressure. The fluid fill inlet is sealed, to isolate the first chamber at the second predetermined pressure, and the second nozzle is removed from the fluid fill inlet.

12 Claims, 8 Drawing Sheets

METHOD FOR INFLATING A BLADDER

BACKGROUND OF THE INVENTION

1. Technical Field

The present invention is directed to a bladder for a shoe midsole, and in particular, to a bladder having a plurality of distinct chambers, with at least one chamber pressurized to a different pressure than the remaining chambers, and a method for so inflating the bladder.

2. Description of the Prior Art

Bladders used for cushioning shoes are known in the art. Such bladders generally are made of an elastomeric material and are formed so as to have an upper or lower surface enclosing one or more chambers therebetween. The chambers are pressurized above ambient pressure by insertion of a nozzle or needle connected to a fluid pressure source into a fill inlet formed in the bladder. After the chambers are pressurized, the fill inlet is sealed, for example, by welding, and the nozzle is removed. A bladder pressurized in this fashion is disposed during manufacture of a shoe between the outsole and the insole for at least a portion of the extent of the shoe. Thus, the bladder forms all or part of the midsole of the shoe and serves to provide cushioning. If desired, a conventional foam material may be disposed between the outsole and insole at the locations not occupied by the bladder to serve as the cushioning midsole at those locations. Further, the bladder may be partially or totally encapsulated by the foam.

Bladders of this type may be manufactured by the prior art two-film technique in which two separate sheets of elastomeric film are formed having the overall peripheral shape of the bladder. The sheets may be welded together along the periphery to form a bladder having upper, lower and side surfaces, and at predetermined interior areas to give the bladder a preferred configuration, that is, to have chambers of a predetermined shape and size at desired locations. Alternatively, the two sheets may be vacuum-formed to have the preferred configuration and then welded together. In either case, the bladder is formed so as to have one or more fluid inlets through which a needle can be inserted to inflate the various chambers.

Bladders also may be manufactured by the prior art blow-molding technique. A liquified elastomeric material is placed in a mold having the desired overall shape and configuration of the bladder. The mold has an opening at one location through which pressurized air is provided. The pressurized air forces the liquified elastomeric material against the inner surfaces of the mold and causes the material to harden in the mold to form a bladder having the preferred shape and configuration. A sprue appendage is formed at the location of the mold opening and may serve as the fluid fill inlet into which a nozzle is inserted.

Bladders manufactured in this manner are especially useful in providing cushioning in athletic shoes. Different types of athletic activities require different degrees of cushioning at different locations throughout the extent of the shoe. Thus, it desirable to manufacture the bladder with chambers which are isolated from each other at different pressures and which have different enclosed volumes. For two chambers having the same volume, the chamber at the higher pressure will provide more resistance to compression, that is, the higher pressure chamber will be stiffer. Similarly, for two chambers at the same pressure, the chamber with the smaller volume will be stiffer. By manufacturing bladders with distinct chambers enclosing different volumes at desired locations throughout the shoe, and by inflating the chambers to a predetermined pressure, a bladder can be made having a desired stiffness at any location of the shoe. The bladder and thus the shoe can be tuned to a particular activity.

However, in the prior art, inflating the chambers to the predetermined pressure has been difficult when it is desired to inflate one or more chambers to a different pressure than the remaining chambers. For example, in the two-film technique, if it is desired for the bladder to have chambers at different pressures, the bladder must be formed so as to have one or more of the chambers isolated from the remaining chambers. However, in order to allow for inflation of the isolated chamber(s), the bladder must be formed with a separate fill inlet for each chamber(s) which is to be inflated at a given pressure. This complicates the manufacturing process and increases expense. Additionally, since it is desirable to have portions of the bladder exposed after assembly in a shoe, and since the fill inlets are aesthetically unappealing, the use of bladders having more than one fill inlet restricts the design possibilities for the shoe. Further, each fill inlet has a smaller diameter than the chambers and thus provides less cushioning.

Similarly, in the blow-molding technique, if it is desired for the bladders to have chambers at different pressures, the bladders must be formed so as to have one or more of the chambers isolated from the remaining chambers, and with a separate fill inlet for each isolated chamber(s). However, it is difficult to manufacture the bladder so as to have more than one sprue, and thus, with more than one fill inlet. Forming bladders with even two sprues is costly and complicated, and depending upon the desired shape and configuration of the bladder, may not be possible at all. Accordingly, with either prior art technique, forming bladders with chambers at predetermined locations having different levels of pressurization is difficult, expensive and sometimes not possible at all.

SUMMARY OF THE INVENTION

The present invention is directed to a method for inflating a bladder including a first and a second distinct chamber linked in fluid communication by an interconnecting port, and a fluid fill inlet linked in fluid communication with the first chamber. A first nozzle set at a first predetermined pressure level and connected to a first fluid pressure source is inserted in the inlet to thereby inflate the first and second chambers to the first predetermined pressure. The interconnecting port is sealed to isolate the first chamber from the second chamber out of fluid communication with each other such that the second chamber is isolated at the first predetermined pressure. The first nozzle is removed from the fluid fill inlet. The fluid inlet is sealed.

In a further embodiment, after removing the first nozzle from the fluid inlet port and before sealing the fluid inlet port, the first chamber is allowed to fill with gas at ambient pressure.

In a further embodiment, after removing the first nozzle from the fluid inlet port and before sealing the fluid inlet port, a second nozzle set at a second predetermined pressure level and connected to a second pressure source is inserted into the fluid inlet port to thereby inflate the first chamber to the second predetermined pressure. After sealing the fluid inlet port to isolate the first chamber at the second predetermined pressure, the second nozzle is removed from the fluid inlet.

In a further embodiment, the invention is directed to a shoe midsole including a bladder. The bladder includes an upper, lower and side surfaces defining a medial chamber, a lateral chamber and a central chamber with the chambers containing a fluid. The bladder includes only a single, sealed fluid inlet. The lateral chamber has a tubular shape and extends along the lateral side of the midsole. The medial chamber has a tubular shape and extends along the medial side of the midsole. The central chamber is disposed between the medial and lateral chambers. At least one of the medial and lateral chambers is isolated out of fluid communication with the central chamber, and the chambers are pressurized to a different pressure than the central chamber.

DETAILED DESCRIPTION OF THE PREFERRED EMBODIMENTS

Figure 1A:
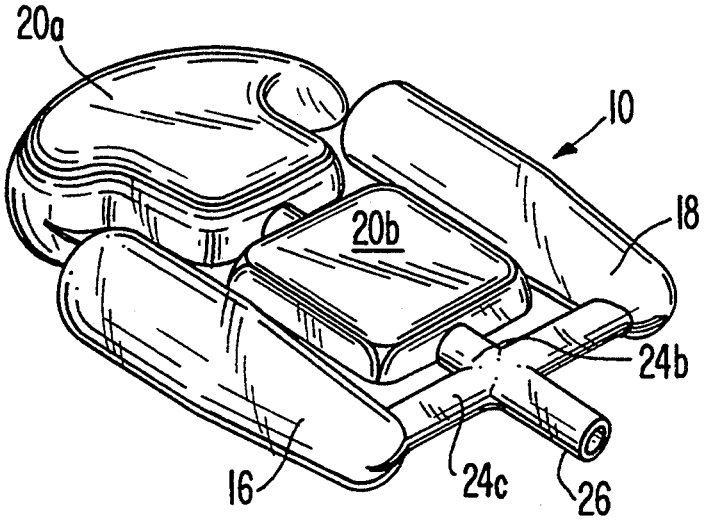
FIG. 1A is an overhead perspective view of a bladder according to a first embodiment of the invention.
Figure 1G:
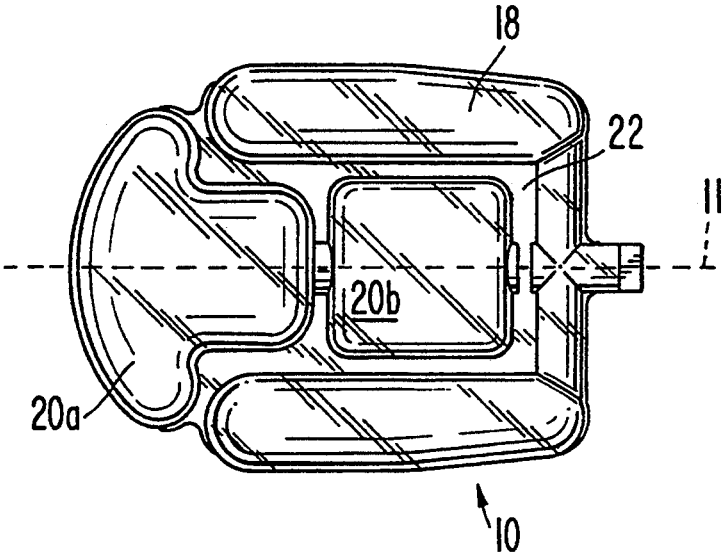
FIG. 1G is a top plan view of the bladder shown in FIG. 1A after one of the interconnecting tubes has been welded closed.
Figure 1B:
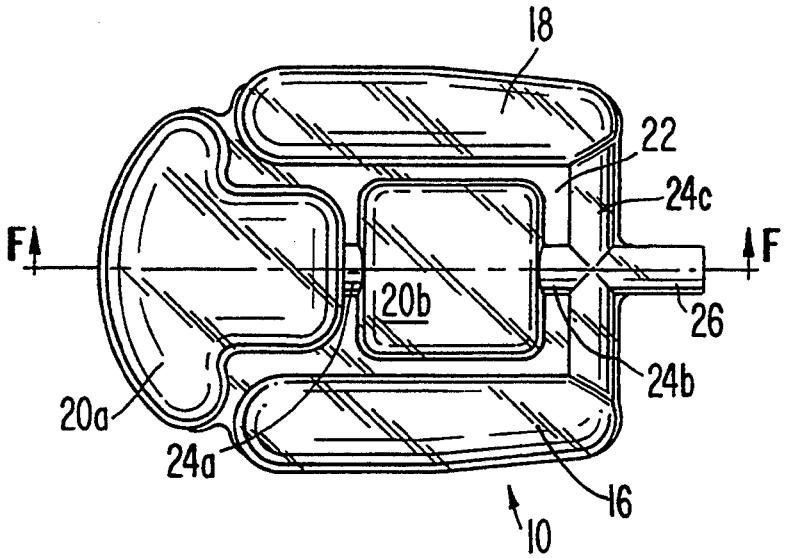
FIG. 1B is a top plan view of the bladder shown in FIG. 1A.
Figure 1C:
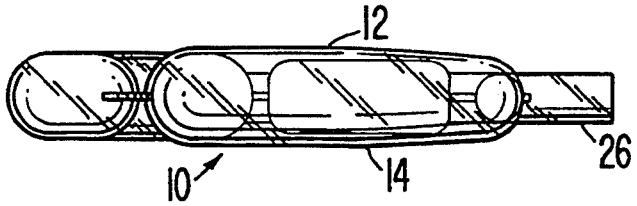
FIG. 1C is a lateral elevational view of the bladder shown in FIG. 1A.
Figure 1D:
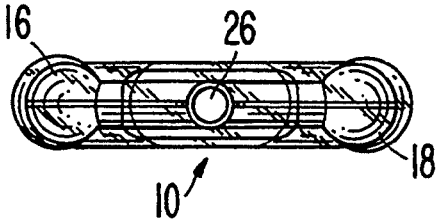
FIG. 1D is a front view of the bladder shown in FIG. 1A.
Figure 1E:
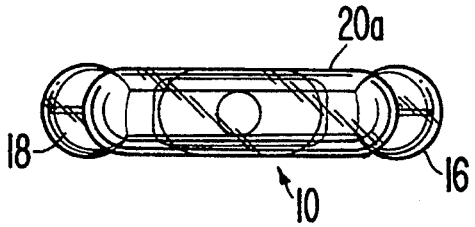
FIG. 1E is a rear view of the bladder shown in FIG. 1A.
Figure 1F:
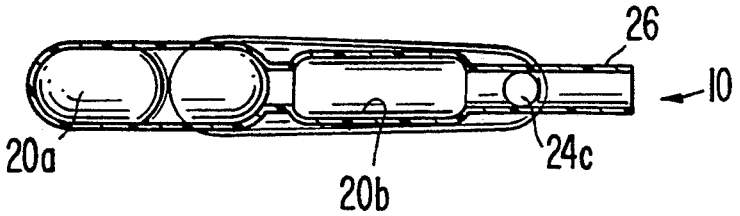
FIG. 1F is a cross-sectional view along line F—F in FIG. 1B.

With reference to FIGS. 1A–1G, bladder 10 is an elastomeric member and includes upper surface 12 and lower surface 14 which are spaced from each other at various locations to enclose a plurality of distinct, variously-shaped chambers 16, 18 and 20 therebetween. Upper surface 12 and lower surface 14 jointly form a side surface for bladder 10. Preferably, bladder 10 is formed in a conventional manner by blow molding. Bladder 10 may be made of a resilient, plastic material such as a cast or extruded ester based polyurethane film having a shore "A" hardness of 80–95, e.g., Tetra Plastics TPW-250. Other suitable materials can be used such as those disclosed in U.S. Pat. No. 4,183,156 to Rudy, incorporated by reference.

In general, chambers 16 and 18 are disposed along the sides of bladder 10 and chambers **20*a* and 20*b* are disposed centrally between chambers 16 and 18. Chambers 16, 18 and 20*a–b* are separated by isolating areas 22 where upper surface 12 and lower surface 14 are not separated from each other and thus preclude fluid communication between chambers 16, 18 and 20*a–b*. In addition to blow molding, bladder 10 may be formed by other known techniques such as forming upper surface 12 and lower surface 14 as separate layers and then welding the layers together about the periphery and at areas 22**.

Figure 2:
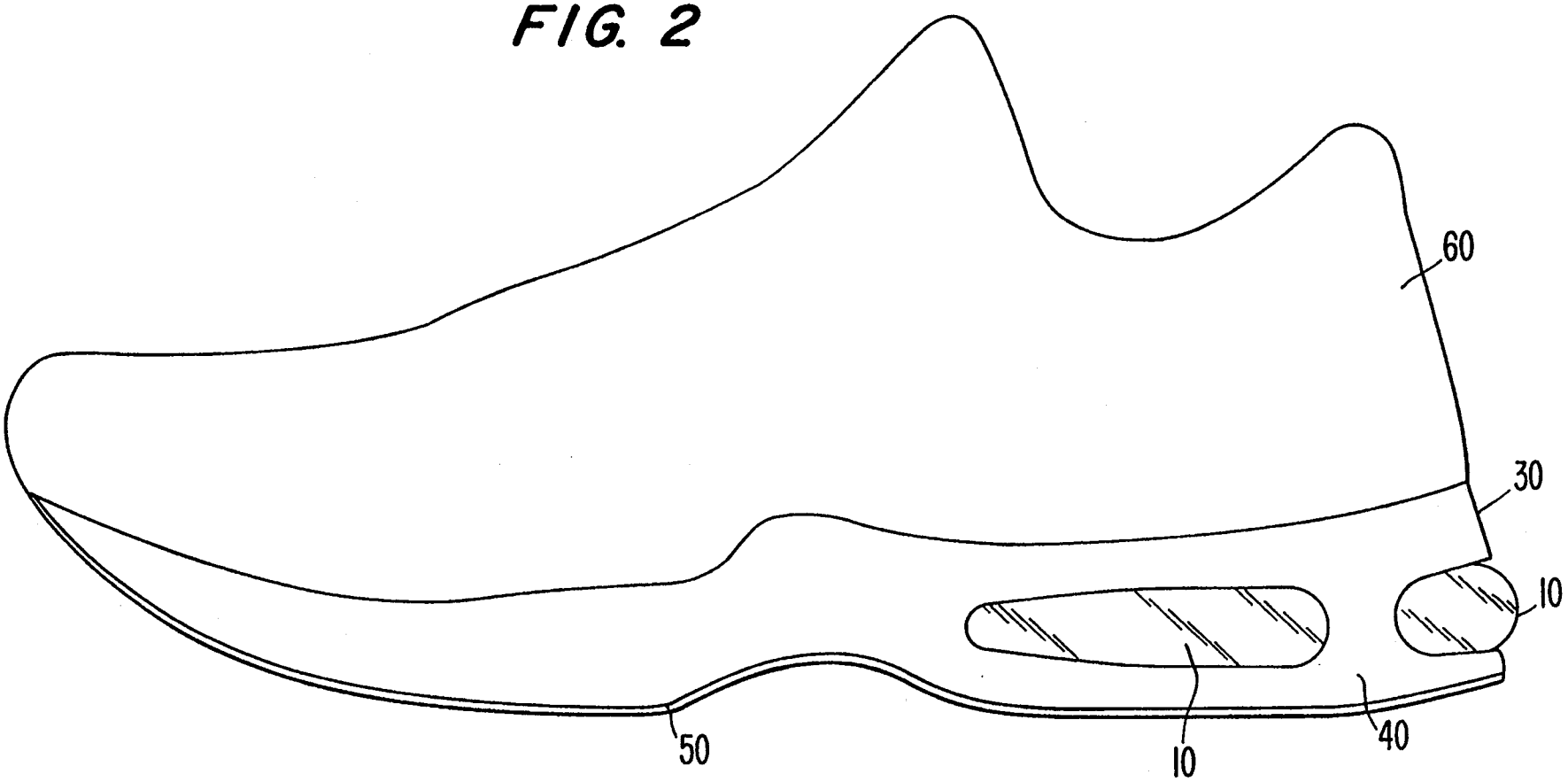
FIG. 2 shows the bladder of FIGS. 1A–G embedded in a shoe midsole.

As shown in FIG. 2, bladder 10 forms part of midsole 30 of shoe 60, and may be encapsulated by foam 40, for example, as described in U.S. Pat. No. 4,219,945 to Rudy, incorporated by reference. In a preferred embodiment, bladder 10 would be disposed in the rearfoot region of shoe midsole 30 and thus may be described as a rearfoot bladder. Conventional outsole 50 is disposed below midsole 30. In the following description, the location of chambers 16, 18 and **20*a–b* and areas 22 will be described with reference to a shoe in which the bladder would be disposed, for example, the terms lateral and medial when used to describe side chambers 16 and 18** would refer to the location of the chamber relative to a shoe.

Bladder 10 is formed substantially symmetrically about longitudinal axis 11. Tube-shaped chambers 16 and 18 are disposed at and form the lateral and medial sides, respectively, of bladder 10. Rear central chamber **20*a* is symmetrically disposed about axis 11 and includes a crescent-shaped rear portion and a rectangular portion extending forwardly from a central location of the crescent-shaped portion so as to give chamber 20*a* an overall key-like shape. The rear ends of lateral and medial chambers 16 and 18 are disposed on either side of the rectangular portion of chamber 20*a*, forward of the crescent-shaped portion. Rear central chamber 20*a* is separated from lateral and medial chambers 16 and 18 by isolating area 22**.

Forward central chamber **20*b* is rectangular and is disposed generally symmetrically about longitudinal axis 11, forward of rear central chamber 20*a*. Chamber 20*b* is linked in fluid communication with chamber 20*a* by interconnecting tube 24*a*. With the exception of the link through tube 24*a*, chamber 20*b* is isolated from chamber 20*a*. The diameter of tube 24*a* is less than that of chambers 16, 18 and 20*a–b*. For example, in one embodiment, the maximum thickness of side chambers 16 and 18 could be approximately 0.77", the maximum thickness of central chambers 20*a–b* could be approximately 0.69" and 0.569", respectively, and the diameter of tube 24*a* could be approximately 0.375". Tube 24*a***, and similar tubes described below, are necked-down portions of the bladder relative to the chambers, and easily may be welded closed. In the following, the terms interconnecting tube and necked-down portion will be used interchangeably.

Interconnecting tube **24*b*** extends forwardly from and is in fluid communication with forward central chamber 20*b*. Interconnecting Tube 24*b* extends generally along longitudinal axis 11. Interconnecting tube 24*c* extends laterally between and is in fluid communication with the forward ends of lateral chamber 16 and medial chamber 18. Interconnecting tubes 24*b* and 24*c* have approximately the same diameter of tube 24*a* and intersect so that the tubes are in fluid communication with each other. A portion of tube 24*b* extends forwardly of tube 24*c* to form fluid fill inlet or sprue 26.

Bladder 10 is pressurized with an appropriate fluid, for example, hexafluorethane, sulfur hexafluoroide or other gases such as those disclosed in the above-mentioned Rudy patents. Bladder 10 is pressurized such that at least one of chambers 16, 18 and 20*a–b* is at a different pressure from the remaining chambers. Differential pressurization is accomplished as follows.

A first nozzle connected to a first fluid pressure source set at a first predetermined pressurization level is inserted in sprue 26. Each of chambers 16, 18 and 20*a–b* is pressurized to the first predetermined pressurization level. The nozzle and fluid source and the manner in which they are set to achieve a predetermined pressurization level are conventional. After pressurization of each chamber of bladder 10 to the first pressurization level, one or more connecting tubes or necked-down portions 24 are welded closed to isolate one or more of the chambers from the remaining chambers. For example, necked-down portion 24*a* may be welded to isolate chamber 20*a*.

After the selected necked-down portions 24 are welded, the first nozzle is removed from sprue 26. Each of the isolated chamber(s) 16, 18 or 20*a–b* will be maintained at the first pressurization level. A second nozzle connected to a second fluid pressure source set at a second predetermined pressurization level is inserted in sprue 26. The remaining chambers, that is, the ones which have not yet been isolated, are pressurized to the second predetermined pressure. Thereafter, sprue 26 could be closed by welding to isolate the remaining chambers at the second pressure. For example, lateral chamber 16, medial chamber 18 and forward central chamber 20*b* would be isolated at the second predetermined pressure.

Alternatively, one or more of the remaining necked-down portions 24 could be welded closed to isolate one or more chambers 16, 18 and 20*b* at the second pressure. For example, necked-down portion 24*b* could be welded to isolate forward central chamber 20*b* at the second pressure. Alternatively, necked-down portion 24*c* could be welded adjacent lateral chamber 16 and/or medial chamber 18 to isolate that chamber(s) at the second pressure. The second nozzle could be removed, and a third nozzle connected to a third fluid source at a third pressurization level would be inserted in sprue 26 to pressurize the remaining nonisolated chamber(s) to the third pressurization level. Sprue 26 would be welded closed to isolate the remaining chamber(s) at the third pressurization level. Alternatively, one or more chambers could be allowed to exist at atmospheric or ambient pressure. In general, the chamber which exists at atmospheric pressure contains only air as the inflatant gas. The air is allowed to fill the selected chamber after removal of the nozzle.

In a preferred embodiment of the invention, bladder 10 will be pressurized at a first pressurization level and a second pressurization level. The higher pressure level will be in a range of 15–50 psi above ambient pressure, for example, 25 psi, and the lower pressure level will be in the range of 0–15 psi above ambient pressure, for example, 5 psi.

By utilizing the above method of pressurizing bladder 10, the bladder can be pressurized so as to have different levels of pressurization at different locations. The number of different pressurization levels is determined based upon how many distinct chambers 16, 18 and 20*a–b* with which bladder 10 is formed, how many necked-down portions 24 are formed in bladder 10 to link the chambers such that after pressurization of a given chamber the chamber can be isolated by welding a necked-down portion 24, and how many nozzles and associated fluid sources are utilized to pressurize bladder 10.

The stiffness of a given chamber 16, 18 and 20*a–b* depends upon both the pressurization and the effective volume of the chamber. Before isolation of one chamber from the remaining chambers, the effective volume of each chamber is the combined volume of all of the chambers. After isolation, the effective volume of the isolated chamber is reduced to the actual volume enclosed by the chamber, and the effective volume of each of the remaining chambers is the combined volume of the remaining chambers. The stiffness or resistance of a chamber depends upon both its effective volume and the pressure, and thus, the stiffness of bladder 10 can be tuned at the location of each chamber by selecting a desired pressure and determining whether the chamber is in fluid communication with one or more additional chambers. It is known that in sealed chambers having roughly the same effective volume, a chamber inflated to 5 psi above ambient pressure will have about one half the stiffness of a chamber inflated to 25 psi above ambient. Thus, bladder 10 may be tuned for a particular activity.

In a preferred embodiment, bladder 10 would be pressurized by insertion of the first nozzle at the first pressurization level in the range of 0–15 psi above ambient, and preferably, at 5 psi. Necked-down portion 24*b* would be welded at a location between forward central chamber 20*b* and necked-down portion 24*c*. Thus, both rear central chamber 20*a* and forward central chamber 20*b* would be isolated at the first pressure. The first nozzle would be removed and the second nozzle would be inserted to inflate lateral and medial chambers 16 and 18 to the second pressurization level in the range of 15–50 psi above ambient, and preferably 25 psi above ambient. Sprue 26 would be sealed forward of necked-down portion 24*b* to isolate chambers 16 and 18 at the higher pressure. Bladder 10 in accordance with this preferred embodiment is shown after sealing in FIG. 1G.

Since lateral and medial chambers 16 and 18 are at a higher pressure than the pressure of central chambers 20*a–b*, and since the effective volume of each isolated chamber 16 and 18 is significantly less than the effective volume of the remaining chambers which are in fluid communication with each other, that is, the combined volume of chambers 20*a–b*, bladder 10 and thus midsole 30 are stiffer at the lateral and medial sides of the heel than in the center. A shoe incorporating bladder 10 would have increased stability and would be especially suited for use in sports such as running to provide increased stiffness on the lateral and medial sides, just forward of the heel.

Figure 3:
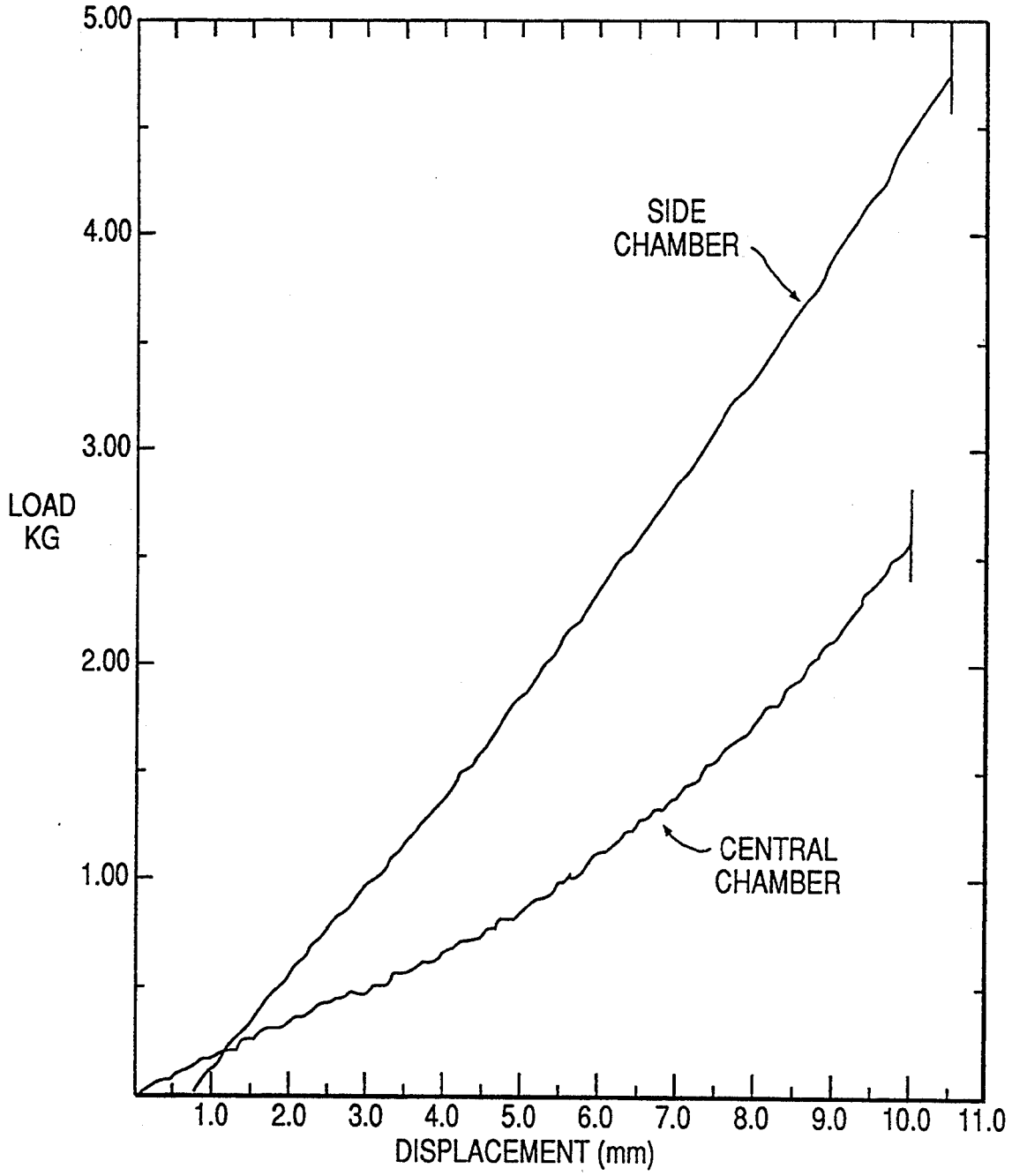
FIG. 3 is a graph showing load versus compression for certain chambers of the bladder shown in FIGS. 1A–G.
Figure 4A:
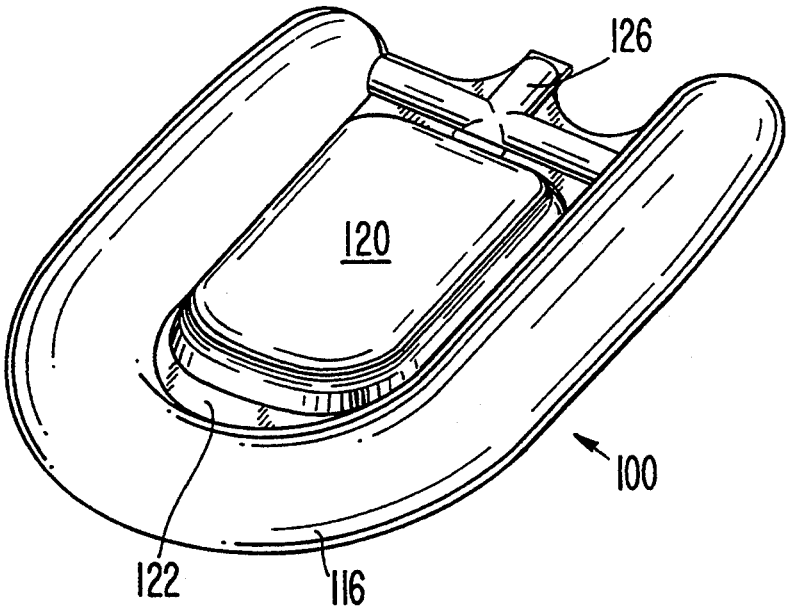
FIG. 4A is an overhead perspective view of a bladder according to a second embodiment of the invention after the interconnecting tubes are welded closed.
Figure 4B:
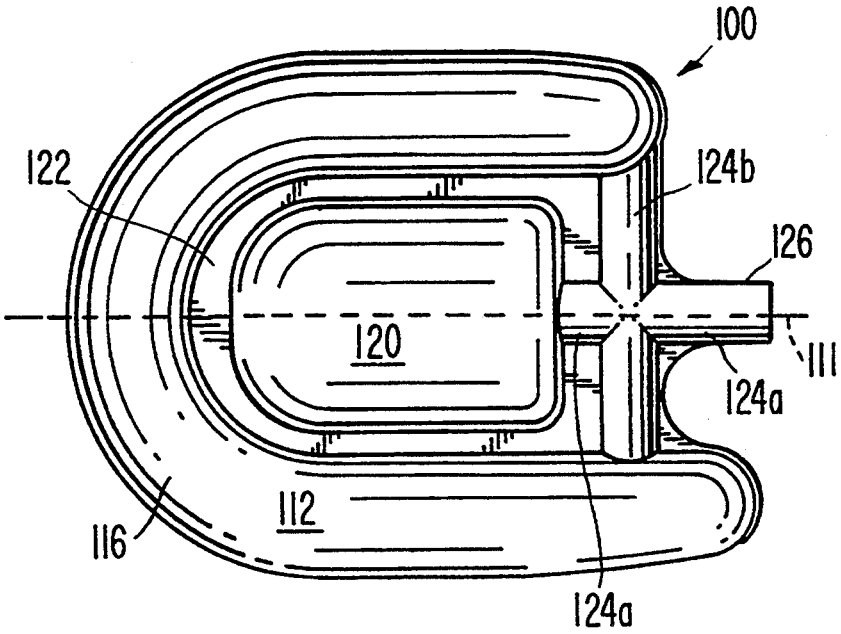
FIG. 4B is a top plan view of the bladder shown in FIG. 4A before the interconnecting tubes are welded closed.
Figure 4C:
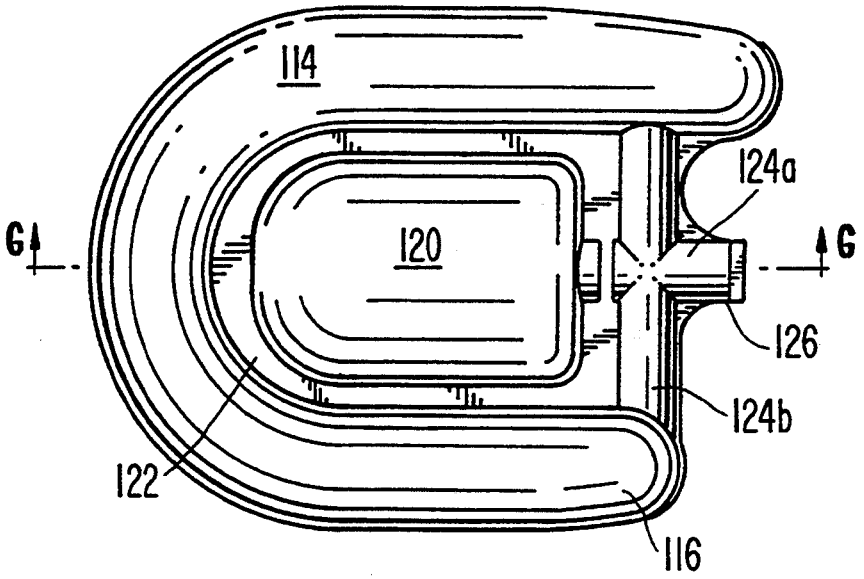
FIG. 4C is a bottom plan view of the bladder shown in FIG. 4A.
Figure 4D:
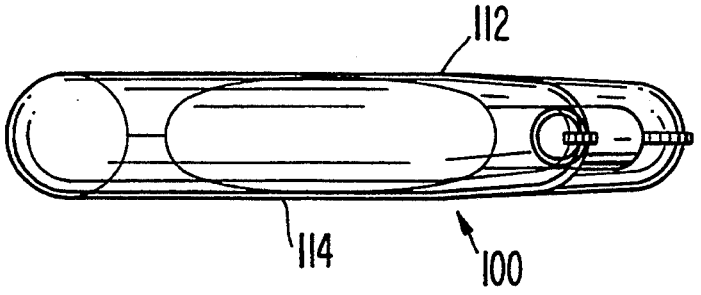
FIG. 4D is lateral elevational view of the bladder shown in FIG. 4A.
Figure 4E:
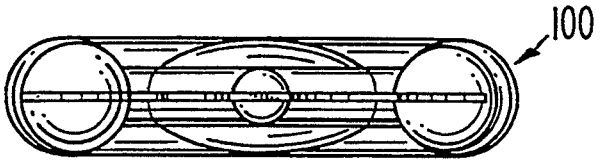
FIG. 4E is a front view of the bladder shown in FIG. 4A.
Figure 4F:
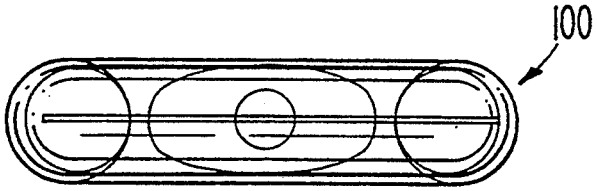
FIG. 4F is a rear view of the bladder shown in FIG. 4A.
Figure 4G:
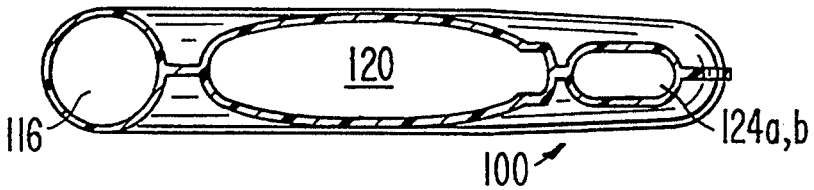
FIG. 4G is a cross-sectional view along line G—G in FIG. 4C.

FIG. 3 is a graph showing the load applied to a bladder versus the compression for a bladder constructed as described above. The results are shown for one side chamber 16 or 18, and rear central chamber 20*a*, with the side chambers inflated to a higher pressure than the central chambers. For the results shown in FIG. 3, the maximum thickness of the bladder at the location of rear central chamber 20*a* was approximately 22 mm or 0.866" and the effective volume of central chamber 20*a* was approximately 34.6 $cm^3$. The thickness of the bladder at the location of side chamber 16 or 18 was 20 mm or 0.787" and the effective volume of the chamber was 48.4 $cm^3$. With the exception of small applied loads, for a given applied load, the displacement of side chambers 16 or 18 is significantly less than the displacement of center chamber 20*a*. Thus, bladder 10 is stiffer at the sides than at the center.

Alternatively, bladder 10 can be pressurized so as to have either lateral chamber 16 or medial chamber 18 having a higher pressure than the other two chambers. This pressurization would be accomplished by isolating the selected chamber at the first pressure by welding necked-down portions 24*c* adjacent thereto. By inflating lateral chamber 16 to a higher pressure than both central chamber 20 and medial chamber 18, bladder 10 will be stiffer on the lateral side relative to the center and medial side. This configuration would be of use in compensating for inversion of the foot during foot-strike, that is, the tendency for the foot to rotate outwardly during foot-strike. Inversion generally occurs with people having a forefoot valgus condition in which the heel is turned outward relative to the leg. A valgus condition is commonly associated with people having high arches.

Conversely, by inflating medial chamber 18 to a higher pressure than lateral chamber 16 and central chamber 20, the medial side of the midsole will be stiffer than the lateral side and center, and eversion or inward rotation of the foot during foot-strike can be controlled. Although eversion during foot-strike is normal, for some people inward rotation of the foot is greater than desired, for example, people having a forefoot varus condition in which the heel is turned inwardly relative to the leg. A varus condition commonly is associated with people having flat feet.

Additionally, the stiffness at various locations of bladder 10 can be adjusted by welding necked-down portion 24*a* closed to isolate rear central chamber 20*a* from front central chamber 20*b* after sprue 26 has been welded closed. As discussed, before isolation of chambers 20*a* and 20*b*, the effective volume of each chamber is the combined volume of both chambers. After isolation, the effective volume of each chamber is reduced to the actual volume of each chamber. Accordingly, after isolation, though the pressure of each chamber would remain at 5 psi above atmospheric, the stiffness or resistance to compression of each chamber would be increased due to the decrease in effective volume. Similarly, by welding closed necked-down portion 24*c* adjacent one or both of lateral and medial chambers 16 and 18, the effective volume of these chambers is reduced, increasing the stiffness of bladder 10 on the lateral and medial sides. By making use of this ability to increase the stiffness of bladder 10 at selected locations, the bladder can be fine tuned for various activities. The above described method for pressurizing the bladder provides the advantage that the bladder may be formed with only one sprue or filling inlet which simplifies the manufacture of the bladder, and eliminates the drawbacks associated with multi-inlet bladders.

With reference to FIGS. 4A–G, a second embodiment of a bladder according to the invention is shown. Bladder 100 would be made of the same materials and manufactured in the same manner as bladder 10 described in FIGS. 1A–G so as to have upper surface 112 and lower surface 114 enclosing a plurality of distinct chambers 116 and 120 therebetween and which jointly form a side surface. Preferably, bladder 100 would be disposed as part of or the entire rearfoot portion of a midsole.

Outer perimeter chamber 116 is tubular and horseshoe-shaped and extends about the periphery of bladder 100 on both medial and lateral sides. Chamber 116 extends more forwardly on the lateral side than on the medial side so as to provide additional cushioning on the lateral side which is where heel strike occurs during normal running or walking. Central chamber 120 is disposed within the space defined by chamber 116 and is spaced therefrom by isolating area 122. Interconnecting tube or necked-down portion 124*a* extends forwardly from central chamber 120, substantially along longitudinal axis 111. Isolated area 122 completely surrounds chamber 120 with the exception of tube 124*a*.

Interconnecting tube or necked-down portion 124*b* extends laterally between the lateral and medial sides of chamber 116, substantially perpendicular to axis 111. Tube 124*b* links the opposite sides of chamber 116 in fluid communication near the forward end of the lateral side and at the forward end on the medial side. Interconnecting tube 124*b* intersects tube 124*a* so that the tubes are in fluid communication with each other. A portion of tube 124*a* extends forwardly of tube 124*b* to form fill inlet or sprue 126. Outer chamber 116 is thicker than central chamber 120, and central chamber 120 is thicker than necked-down portions 124*a–b*. For example, outer chamber 116 could have a maximum thickness of approximately 0.770", central chamber 120 could have a maximum thickness of approximately 0.494" and tubes 124*a–b* could have a diameter of approximately 0.375".

Bladder 100 is inflated in substantially the same manner as bladder 10 so as to allow outer chamber 116 to have a different pressure than central chamber 120. For example, a first nozzle connected to a first fluid pressure source set at a first predetermined pressure is inserted in sprue 126. Chambers 116 and 120 are inflated to a first predetermined pressure. Necked-down portion 124*a* is welded closed at the location between central chamber 120 and the intersection of necked-down portions 124*a* and 124*b*, thereby sealing central chamber 120 at the first pressure.

The first nozzle is removed and a second nozzle connected to a second fluid pressure source set at a second predetermined pressure is inserted into sprue 126. Outer chamber 116 is inflated to the second pressure, and sprue 126 is welded closed at a location adjacent to and forward of necked-down portion 124*b*. Bladder 100 having both necked-down portion 124*a* and sprue 126 welded closed is shown in FIG. 4A and 4C–G, while necked-down portion 124*a* and sprue 126 are open in FIG. 4B.

In a preferred embodiment, outer chamber 116 is inflated to a pressure above that of central chamber 120. For example, central chamber 120 is inflated in a range of 0–15 psi above ambient pressure, and preferably 5 psi above ambient pressure, and outer chamber 116 is inflated in a range of 15–50 psi above ambient pressure, and preferably to 25 psi above ambient pressure. Bladder 100 inflated in this manner is stiffer around the periphery than in the center of the rearfoot to provide increased rearfoot stability. Bladder 100 is especially useful in basketball and cross-training shoes.

Figure 5:
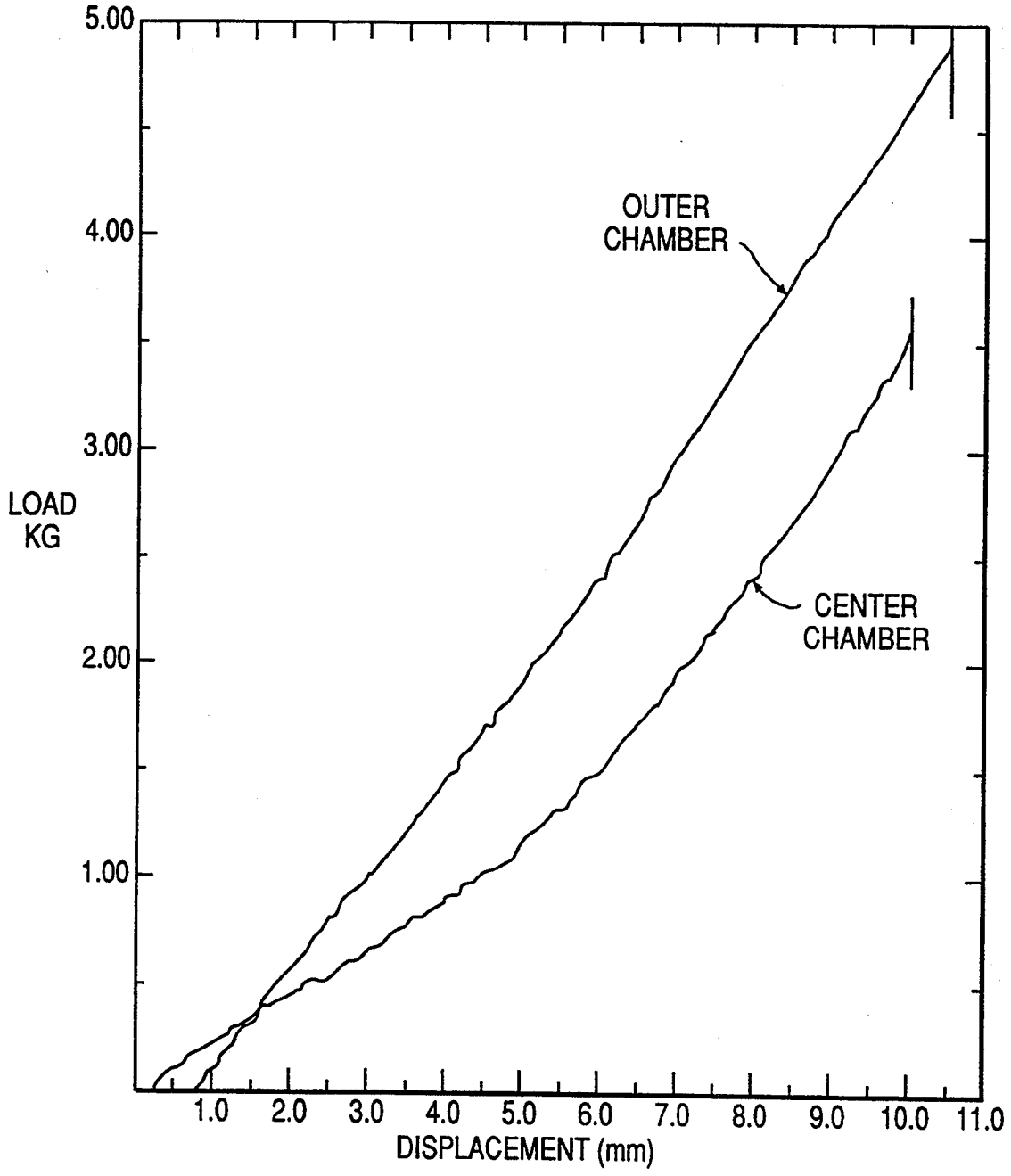
FIG. 5 is a graph showing load versus compression for certain chambers of the bladder shown in FIGS. 4A–G.

FIG. 5 is a graph showing the load applied to a bladder versus the compression for a bladder constructed according to the second embodiment. The results are shown for outer perimeter chamber 116 inflated to a higher pressure than central chamber 120. For the results shown in FIG. 5, the maximum thickness of the bladder at the location of central chamber 120 was approximately 19 mm or 0.748" and the effective volume of central chamber 120 was approximately 26.9 $cm^3$. The thickness of the bladder at the location of outer perimeter chamber 116 was 20 mm or 0.787" and the effective volume of the chamber was 70.6 $cm^3$. Again, with the exception of small applied loads, for a given applied load, the displacement of outer chamber 116 is significantly less than the displacement of central chamber 120. Thus, bladder 100 is stiffer at the sides than at the center.

In all of the above embodiments, the bladders are inflated such that the chambers may have pressures which differ from each other by the use of two separate nozzles which are connected to separate pressure sources. Alternatively, the bladders may be inflated by using only one nozzle connected to only one fluid pressure source. The nozzle would be inserted in the sprue, and all of the bladder chambers would be inflated to a first pressure level. A selected one of the interconnecting tubes or necked-down portions would be welded closed. The pressure gauge on the nozzle would be adjusted to a predetermined second pressure and the remaining chambers would be inflated to the second pressure. Thereafter the sprue would be sealed, and the nozzle would be withdrawn. This process can be repeated for any number of different chambers or pressures. In order to avoid having to withdraw the nozzle before the second selected chamber(s) are inflated, it is preferred to first inflate the lowest pressure chambers.

Alternatively, the above method of inflating may be used in bladders formed by the two-film technique in which the bladders would be formed with a single fill inlet. The bladders would be inflated by insertion of a needle in the inlet, as taught in the above mentioned Rudy patent, instead of a nozzle.

We claim:

1. A method for inflating a bladder, the bladder comprising at least a first and a second distinct chamber, the chambers linked in fluid communication by an interconnecting port, and a fluid fill inlet linked in fluid communication with the first chamber, said method comprising the steps of:

inserting a first nozzle set at a first predetermined pressure level and connected to a first fluid pressure source into the fluid fill inlet to thereby inflate the first and second chambers to the first predetermined pressure;

sealing said interconnecting port to isolate the first chamber from the second chamber out of fluid communication with each other such that the second chamber is isolated at the first predetermined pressure;

removing the first nozzle from the fluid fill inlet; and sealing the fluid fill inlet.

2. The method recited in claim 1 comprising the further steps of:

after removing the first nozzle from the fluid fill inlet and before sealing the fluid fill inlet, inserting a second nozzle set at a second predetermined pressure level and connected to a second pressure source into the fluid fill inlet to thereby inflate the first chamber to the second predetermined pressure; and after sealing the fluid fill inlet to isolate the first chamber at the second predetermined pressure, removing the second nozzle from the fluid fill inlet.

3. The method recited in claim 2, the second predetermined pressure being greater than the first predetermined pressure.

4. The method recited in claim 3, the second predetermined pressure having a value in a range of 15–50 psi above ambient pressure and the first predetermined pressure having a value in a range of ambient pressure to 15 psi above ambient pressure.

5. The method recited in claim 4, the second predetermined pressure being approximately 25 psi above ambient pressure and the first pressure being 5 psi above ambient pressure.

6. The method recited in claim 2, the bladder comprising a third distinct chamber, the first chamber disposed on one of the medial and lateral sides of the bladder, the third chamber disposed on the other of the medial and lateral sides of the bladder, and the second chamber disposed centrally between the first and third chambers, the second and third chambers linked in fluid communication by an additional interconnecting port, wherein:

the step of inserting the first nozzle and inflating the first and second chambers to the first predetermined pressure also includes inflating the third chamber to the first predetermined pressure.

7. The method recited in claim 6, wherein, the step of sealing the interconnecting port also includes sealing the additional interconnecting port to isolate the third chamber at the first predetermined pressure.

8. The method recited in claim 7, the second predetermined pressure being greater than the first predetermined pressure.

9. The method recited in claim 7, the second predetermined pressure being less than the first predetermined pressure.

10. The method recited in claim 1 comprising the further step of allowing the first chamber to be filled with a gas at ambient pressure after removing the first nozzle and before sealing the fluid fill inlet.

11. The method recited in claim 10, wherein, the gas is atmospheric air.

12. A method for inflating a bladder, the bladder comprising at least a first and a second distinct chamber, the chambers linked in fluid communication by an interconnecting port, and a fluid fill inlet linked in fluid communication with the first chamber, said method comprising the steps of:

inserting a nozzle connected to a fluid pressure source and having a pressure gauge thereon set at a first predetermined pressure level into the fluid fill inlet to thereby inflate the first and second chambers to the first predetermined pressure;

sealing the interconnecting port to isolate the first chamber from the second chamber out of fluid communication with each other such that the second chamber is isolated at the first predetermined pressure;

setting the nozzle gauge to a second predetermined pressure level and thereby inflating the first chamber to the second predetermined pressure;

sealing the fluid fill inlet to isolate the first chamber at the second predetermined pressure; and removing the nozzle from the fluid fill inlet.

* * * * *